US008418621B2

(12) United States Patent
Kruse et al.

(10) Patent No.: US 8,418,621 B2
(45) Date of Patent: Apr. 16, 2013

(54) CARTRIDGE AMMUNITION

(75) Inventors: Olaf Kruse, Glinde (DE); Detlef Haeselich, Muessen (DE)

(73) Assignee: Rheinmetall Waffe Munition GmbH, Trittau (DE)

( * ) Notice: Subject to any disclaimer, the term of this patent is extended or adjusted under 35 U.S.C. 154(b) by 0 days.

(21) Appl. No.: 13/055,740

(22) PCT Filed: Jul. 24, 2009

(86) PCT No.: PCT/DE2009/001039
§ 371 (c)(1),
(2), (4) Date: Jul. 6, 2011

(87) PCT Pub. No.: WO2010/009723
PCT Pub. Date: Jan. 28, 2010

(65) Prior Publication Data

US 2011/0252998 A1 Oct. 20, 2011

(30) Foreign Application Priority Data

Jul. 25, 2008 (DE) ..... 10 2008 034 660

(51) Int. Cl.
*F42B 5/28* (2006.01)

(52) U.S. Cl.
USPC ..... 102/469

(58) Field of Classification Search ..... 102/469, 102/470, 471, 472, 502–503, 520
See application file for complete search history.

(56) References Cited

U.S. PATENT DOCUMENTS 2,892,408 A * 6/1959 Simpson ..... 102/469
4,702,027 A * 10/1987 Stanley ..... 42/76.02
7,004,074 B2 * 2/2006 Van Stratum ..... 102/470

FOREIGN PATENT DOCUMENTS

| | | | |
|---|---|---|---|
| CH | 628976 | A5 | 2/1977 |
| DE | 2307907 | | 2/1973 |
| DE | 4034880 | A1 | 11/1990 |
| DE | 19700240 | C1 | 1/1997 |
| EP | 0435830 | A1 | 4/1990 |
| FR | 27729 | | 3/1923 |
| FR | 1034877 | | 3/1951 |
| JP | 200671179 | A | 9/2004 |
| NL | 7701182 | | 2/1997 |
| WO | 8606466 | A1 | 11/1986 |
| WO | 2004015359 | A1 | 2/2004 |

* cited by examiner

*Primary Examiner* — Stephen M Johnson
*Assistant Examiner* — John D Cooper
(74) *Attorney, Agent, or Firm* — Karl F. Milde, Jr.; Eckert Seamans Cherin & Mellott, LLC

(57) ABSTRACT

The cartridge ammunition (1) comprises a projectile (11) and a cartridge shell (10) receiving the same. The cartridges of the ammunition are magazined in a belt (31) and are pulled out of the belt by means of an unbelting device and transferred into the lock of the automatic firearm so that the individual projectiles (11) can be shot from the automatic firearm at a high shooting frequency. To minimize the forces abruptly exerted on the bottom flange of the cartridge shell (10) by means of the removal of the cartridge ammunition from the belt, at least one recess (33) is provided in the bottom flange (32) of the cartridge shell (10), thus increasing the bending elasticity of the bottom flange, e.g. by reducing the thickness of the bottom flange. The recesses (33) may e.g. be designed as a groove (33*a*) or as a series of blind bores (33*b*) that extend in parallel to the edge of the bottom flange.

7 Claims, 2 Drawing Sheets

CARTRIDGE AMMUNITION

BACKGROUND OF THE INVENTION

The invention relates to a cartridge ammunition consisting of a projectile, and a cartridge shell receiving Such a cartridge ammunition is used as a live ammunition or as a practice ammunition, preferably in connection with automatic firearms and in particular automatic guns of medium caliber of about 40 mm. For this purpose, the cartridge ammunition is magazined in a belt that, customarily, is guided in the upper portion of the cartridge shell, which faces the projectile. In its bottom the cartridge shell has a flange slightly radially projecting beyond the circumference of the projectile, which forms the bottom of the cartridge ammunition.

When firing the projectile, the belt is pushed into the lock of the automatic firearm, and, for inserting the cartridge ammunition into the barrel of the automatic firearm, two retaining claws of an unbelting device of the lock customarily encompass the bottom flange of the cartridge shell and, first of all, abruptly pull the cartridge ammunition with the lock towards the rear out of the belt and then transfer it into the barrel of the weapon. During the unbelting of the ammunition the bottom flange of the cartridge shell is mechanically stressed to a very great extent on account of the shearing force that occurs. In some cases it happens that parts of the radial bottom flange of the cartridge shell are torn off. The cartridge is no longer held in the lock and also not further transported.

Consequently, the automatic firearm no longer operates properly.

It was attempted to solve this problem by increasing the thickness and/or the strength of material of the bottom flange and/or by selecting a tighter material for the bottom flange. This certainly resulted in improvements, but has its limits, since, construction-related, the dimensions of the individual parts of the cartridge ammunition are virtually determined by standards. Moreover, such measures increase the price for the thicker or stronger material and the additional processing costs.

SUMMARY OF THE INVENTION

The principal objective of the present invention is to provide a cartridge ammunition of the type described above, in which the shearing off of the edge of the bottom flange of the cartridge shell, which projects beyond the circumference of the projectile is prevented by means of simple measures.

This objective, as well as further objectives that will become apparent from the discussion that follows, are achieved, in according to the present invention, by providing, in the bottom flange of the cartridge shell at least in the area of the retaining claws of the unbelting device, a reduction in thickness to such an extent that the bottom flange can be bent there to a greater extent, i.e., such that the bending stability of the bottom is fundamentally increased. The abrupt forces occurring during the unbelting of the cartridge ammunition are introduced into the bottom of the cartridge ammunition as bending forces due to this increased bending elasticity, i.e. due to the possibility of a stronger bending of the bottom flange instead of acting upon the same by shearing forces as has been the case till now. Due to this, the loads are absorbed without the bottom flange or parts thereof being sheared off.

The recess and/or recesses may be designed in a multiplicity of ways. One possibility is a relief groove extending in parallel to the circumferential edge of the bottom flange of the cartridge sleeve at a close distance. Likewise, it may be provided to provide relief blind bores or relief grooves extending approximately along the circumference of the bottom flange of the cartridge shell in a ring-shaped manner in the bottom flange. It is also conceivable to process the edge of the bottom flange e.g., by providing the same with radial recesses or grooves. Grooves or a series of blind bores extending in a radial or star-shaped fashion may also be provided.

For example, a relief groove may be provided in a cartridge ammunition having a diameter of 40 mm, which extends at a distance of 4 mm from the edge of the bottom flange in parallel to it and having width of 2 mm and a depth of 4 mm.

The measures provided by the invention are very simple and also reasonably priced, since only an insignificant additional mechanical processing of the bottom flange of the cartridge shell is required.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
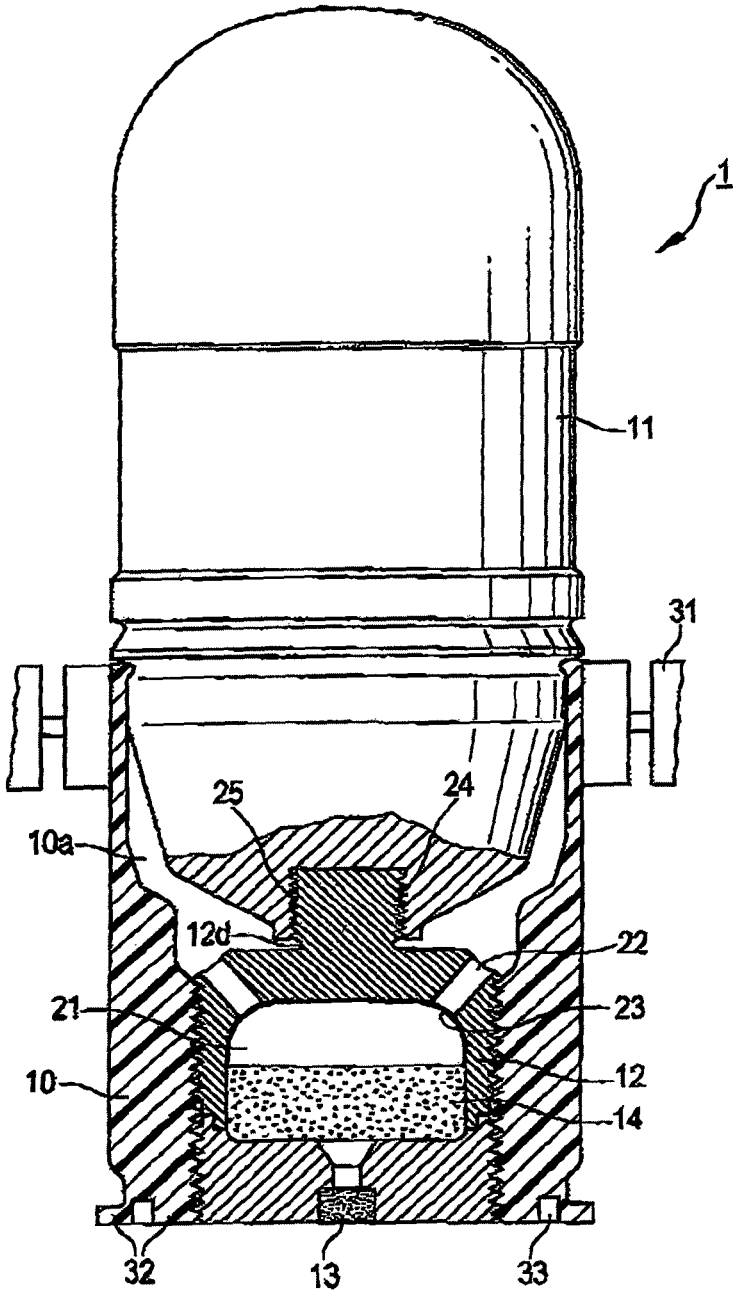
FIG. 1 shows a view of a cartridge ammunition according to the invention, the ammunition being partially cut away in the longitudinal direction, which ammunition has recesses provided in the bottom of the cartridge shell in accordance with the present invention.

The preferred embodiments of the present invention will now be described with reference to FIGS. 1-4 of the drawings. Identical elements in the various figures are designated with the same reference numerals.

A partially cut representation of a cartridge ammunition 1 is shown in FIG. 1. The ammunition 1, which may have a caliber of 40 mm, for example, comprises a cartridge shell 10 and a projectile 11 received in it.

An ignition charge 13 and a propellant charge 14 are accommodated in a cartridge 12 screwed into the bottom of the cartridge shell 10. Here, the cartridge 12 delimits a high-pressure chamber 21, in which the propellant charge 14 burns after the ignition by the ignition charge 13. The high-pressure chamber 21 is connected with a low-pressure chamber 10*a* forming the inner space of the cartridge shell 10 via several overflow openings 22, which are possibly covered with a cover 23, the low-pressure chamber being delimited by the walls of the cartridge shell 10 and the bottom of the projectile 11.

The cartridge 12 is provided with an external thread 24 projecting upwards on its upper side onto which a corresponding internal thread 25 is screwed at the rear of the projectile. A rated break point 12*d* is provided in the area of the transition between the upper wall of the cartridge 12 and the thread 24.

The described cartridge ammunition is e.g. shot from automatic firearms with a high shooting frequency as a practice ammunition. Here, the individual cartridges are magazined in the belt 31 which is only shown in outlines and which surrounds the cartridges in the upper portion of the cartridge shell 10.

At its lower edge the cartridge shell 10 has a bottom flange 32, which slightly projects radially beyond the diameter of the projectile 11, and whose lower side forms the bottom of the cartridge shell. According to the invention one or several recesses 33 are provided in the bottom of the cartridge shell.

Figure 2:
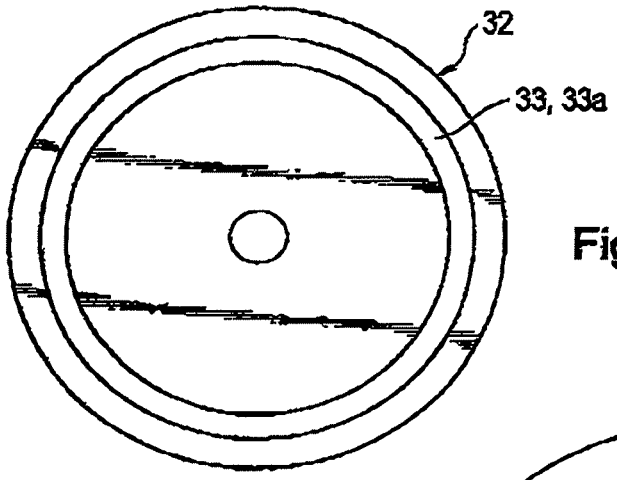
FIGS. 2, 3 and 4 show views of the bottom of the cartridge shell with different designs of the recesses.

According to a first embodiment the recesses are formed by a groove 33*a* that is shown in FIG. 2 and is in parallel with the circumferential edge of the bottom flange 32 and is disposed at a small distance from the circumferential edge. The thickness of material of the bottom flange 32 is reduced there due to the groove and the bending elasticity of the bottom flange is thereby increased. Then, the edge of the bottom flange can be bent "downwards" during the unbelting of the cartridge ammunition by means of the retaining claws of the lock of the automatic firearm, the width of the groove at the bottom of the cartridge shell being reduced.

Figure 3:
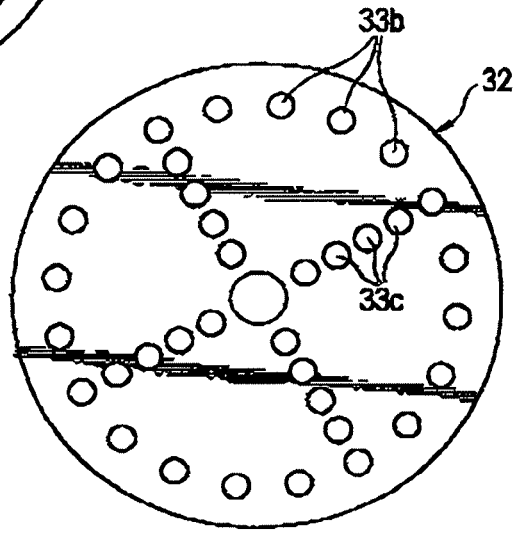

According to FIG. 3 the recesses are designed as individual blind bores 33*b*, which, like the groove 33*a*, are located in a circle in parallel to the edge of the bottom flange at a small distance to each other. The blind bores, in turn, are dimensioned in such a way that they make possible a greater bending of the edge of the bottom flange.

It is likewise possible to additionally provide recesses by means of grooves or blind bores 33*c* starting e.g. in a star-shaped manner from the center of the bottom flange as is outlined in FIG. 3.

Figure 4:
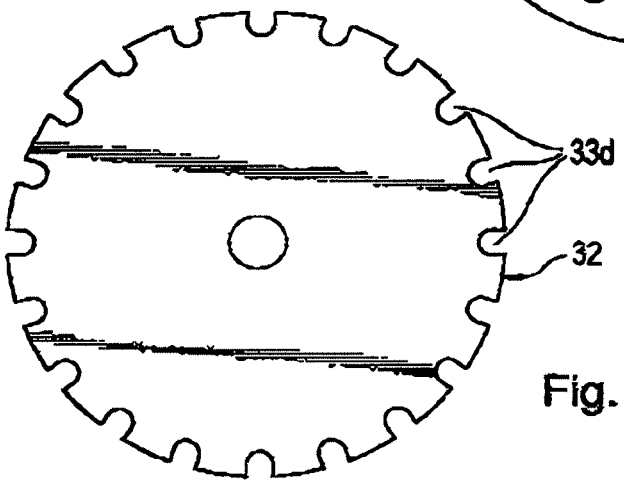

A further possibility for increasing the bending elasticity of the bottom flange 32 is shown in FIG. 4. Here, the outer edge of the bottom flange 32 is provided with recesses 33*d*. These recesses 33*d* are designed as grooves or the like pointing in the direction of the center of the bottom flange 32 from its circumference, which are located at a small distance from each other.

It has been proven in practice, with all represented and similar variants, that no problems occur upon the shooting of the cartridge ammunition from the belt of an automatic gun and a shearing off of the edge of the bottom flange is avoided.

There has thus been shown and described a novel cartridge ammunition which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

The invention claimed is:

1. A cartridge ammunition comprising an unsplined projectile and a cartridge shell receiving it, both of which define a longitudinal direction of said ammunition, the cartridge ammunition being adapted to be magazined in a belt for an automatic firearm and the cartridge shell having a bottom with a radially disposed bottom flange, the bottom flange having a given width in said longitudinal direction, wherein the cartridge shell has at least one recess adjacent to the bottom flange which is configured and disposed in such way that the bending elasticity of the bottom flange is increased, said recess having a depth in said cartridge shell which is equal to or greater than said width of said bottom flange and being disposed at a distance from said bottom flange which provides bending elasticity while maintaining sufficient strength in the cartridge shell to withstand the mechanical stress of automatically unbelting the ammunition.

2. The cartridge ammunition according to claim 1, adapted to be pulled out of the belt by means of an unbelting device, with the edge of the radially disposed bottom flange of the cartridge shell with said at least one recess adapted to being engaged by the unbelting device.

3. The cartridge ammunition according to claim 1, wherein the at least one recess is disposed along a circumference of the bottom flange at a small distance from an outer edge of the bottom flange.

4. The cartridge ammunition according to claim 1, wherein the at least one recess is formed as at least one groove which extends substantially concentrically about the center of the bottom flange near an outer edge of the bottom flange.

5. The cartridge ammunition according to 1, wherein the at least one recess is formed as a series of blind bores which are disposed substantially concentrically about the center of the bottom flange near the outer edge of the bottom flange.

6. The cartridge ammunition according to claim 1, where a plurality of recesses are provided, which are formed as round holes adjacent the bottom flange.

7. The cartridge ammunition according claim 6, wherein at least some of the recesses are radially disposed in the bottom flange.

* * * * *